US005292365A

United States Patent [19]

Delfosse

[11] Patent Number: 5,292,365

[45] Date of Patent: Mar. 8, 1994

[54] MINERAL FILLERS AND PIGMENTS CONTAINING CARBONATE

[75] Inventor: Pierre Delfosse, Rutland, Vt.

[73] Assignee: Pleuss Staufer AG, Oftringen, Switzerland

[21] Appl. No.: 936,269

[22] Filed: Aug. 27, 1992

[30] Foreign Application Priority Data

Aug. 22, 1991 [DE] Fed. Rep. of Germany ..... 4128570

[51] Int. Cl.[5] ..... C04B 14/28

[52] U.S. Cl. ..... 106/464; 106/400; 106/463; 423/430

[58] Field of Search ..... 106/400, 463, 464; 423/430; 428/54

[56] References Cited

U.S. PATENT DOCUMENTS

| | | | |
|---|---|---|---|
| 3,940,550 | 2/1976 | Delfosse et al. | 428/511 |
| 4,244,933 | 1/1981 | Shibazaki et al. | 423/430 |
| 4,284,546 | 8/1981 | Delfosse et al. | 427/358 |
| 4,725,318 | 2/1988 | Minayoshi et al. | 106/464 |
| 4,767,464 | 8/1988 | Strauch et al. | 106/464 |
| 4,808,654 | 2/1989 | Rolfe et al. | 524/424 |
| 4,835,195 | 5/1989 | Rayfield et al. | 523/220 |

*Primary Examiner*—Mark L. Bell
*Assistant Examiner*—M. Marcheschi
*Attorney, Agent, or Firm*—Townsend and Townsend

[57] ABSTRACT

Mineral fillers, pigments and similar materials containing carbonate are described which are characterized in that they have a) a rhombohedral or primarily round particle form b) a steepness factor of between 1.1 and 1.4 c)

$$\text{a ratio } R = \frac{\%\text{ of particles} < 1\ \mu m}{\%\text{ of particles} < 0.2\ \mu m} = 8 \text{ to } 19$$

and d) an average statistical particle diameter of between 0.4 and 1.5 μm.

These materials may be used in the paper industry both as paper fillers and as coating pigments.

19 Claims, 1 Drawing Sheet

MINERAL FILLERS AND PIGMENTS CONTAINING CARBONATE

Figure 1:
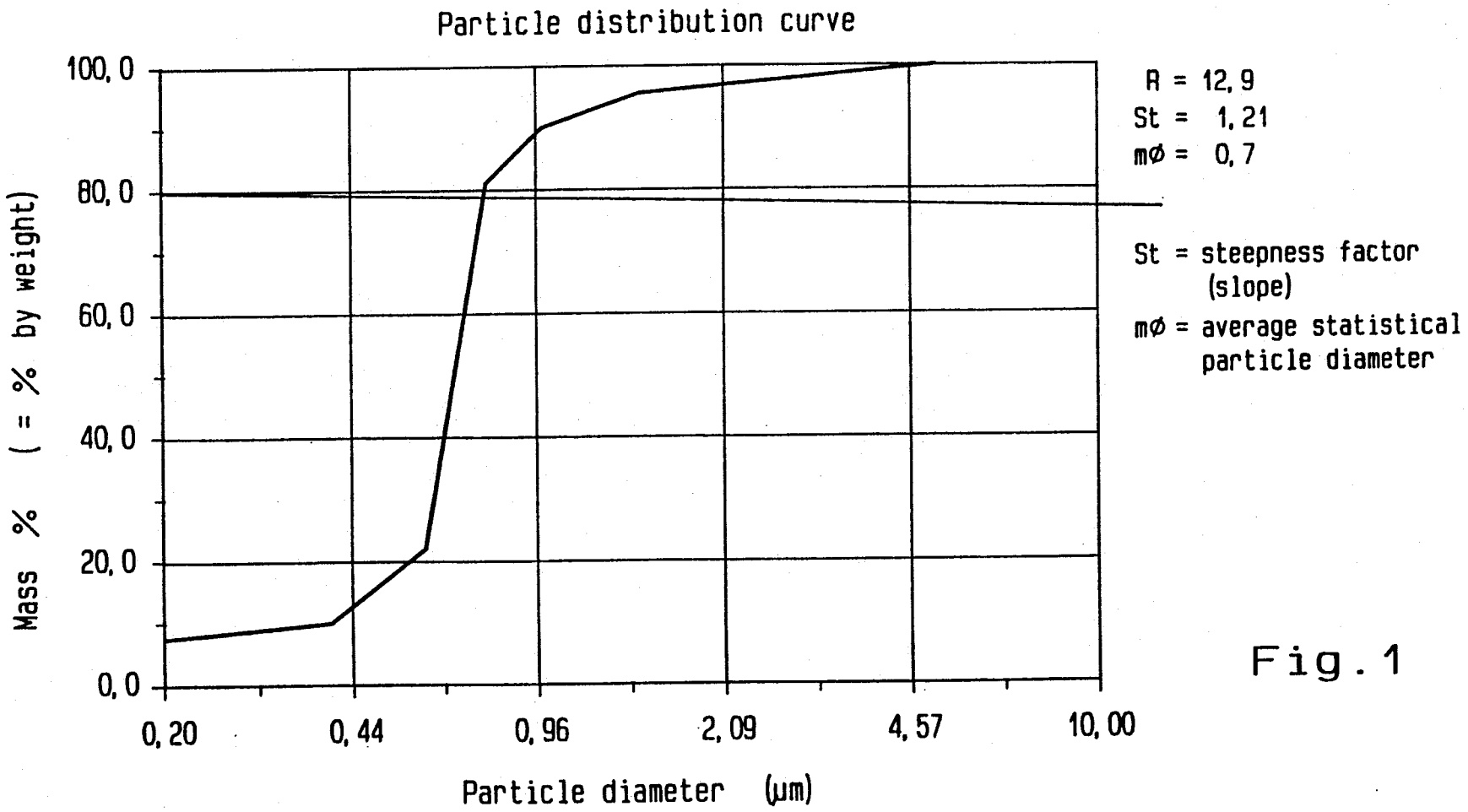

The present invention concerns mineral fillers, pigments and similar materials containing carbonate.

According to the state of the art, various products are used in the paper industry as paper fillers, particularly paper pulp fillers, on the one hand, and as coating pigments on the other. The reason for this is the various different objectives of each type of application.

Mineral fillers are used on a large scale in paper manufacture. Their function consists primarily of increasing the opacity of the paper and, in some cases, its level of brightness. Relatively inexpensive mineral fillers include china clay, ground or precipitated calcium carbonate, calcium sulphates etc. These are less expensive than cellulose fibres and reduce the raw material costs of the paper.

Other fillers, such as titanium dioxide, are more expensive and are used to increase the opacity of the paper.

In addition to optical properties, mineral fillers also influence many other aspects of the paper, such as its weight, volume, porosity, mechanical properties, particularly bursting strength, the smoothness of the surface, and printing characteristics.

Depending on the type of paper and the required properties, the total quantity of mineral fillers used generally varies between 5 and 25% of mass.

In the past ten years, there has been a continual and intensive trend towards alkaline and neutral papers, in contrast to acid papers, whereby resin and aluminium sulphate are used with pH values of between 4 and 5. One of the advantages of alkaline manufacture in the pH range of 7-8 is that the mechanical properties of the paper are improved, thereby theoretically facilitating the use of greater filling weights.

An additional advantage of alkaline manufacture it the possibility of using calcium carbonates as fillers, which is impossible for pH values of less than 7 under normal conditions "Papermakers Conference (1991)", pp. 321-330, refers to "PCC fillers for groundwood papers" which can also be used for pH values of between 5.0 and 7.0.

China clay is the most widely used filler in acid papers, whereas calcium carbonates are preferred in alkaline papers primarily because of the greater level of brightness compared with clay.

The ideal requirements which a paper filler should meet are as follows:

brightness 95+ Elrepho Tappi filter costs: cheaper than fibres high level of opacity minimal influence on mechanical properties the possibility of achieving high fill ratios i.e. greater than 25% no abrasion on the sieve of the paper machine good drainage the possibiliy of manufacturing in large quantities At the current time, there is no mineral filler which meets all the above requirements simultaneously.

China clay or so-called filler clay is cheap, but the brightness level is low and in the range 82-85. This value is not suitable for fine, wood-free, uncoated papers, such as repro papers.

Calcium sulphate is used as paper filler in small quantities because its level of water solubility is too high and it leads to poor opacity.

Calcium carbonates are the best paper fillers because their brightness level is in the range 93-96 TAPPI. There are two principal types of calcium carbonates:

1. Natural, ground calcium carbonates, such as ground calcite limestone, ground white marble and occasionally, sedimentary chalks, the latter of which produce a low level of brightness.

2. Precipitated calcium carbonates, generally obtained from the carbonisation of calcium hydroxide. The main advantage of precipitated calcium carbonates (hereafter referred to as PCC) is their relatively high dispersion coefficient and good opacity. This is based on the particle form of the crystal conglomerates, which is generally a blend of aragonite and calcite scalenohedrons. These conglomerates have the form of so-called rosettes and are responsible for good light dispersion.

However, this particle form, which is in itself beneficial, has a negative influence on some other factors, such as:

water retention, which reduces drainage of the wet paper on the sieve high energy consumption for drying the paper loose connection between fibres, which has a negative influence on mechanical properties excessive volume, which entails the risk of delamination of the paper during printing calcium carbonate remains which reacts with the manufacturing agents excessive porosity.

The main disadvantage of precipitated calcium carbonates as paper fillers is undouptedly the limitation of the fill ratio, which barely exceeds the range 15-20%.

In view of the fact that the price of paper pulp (cellulose fibres) is generally three to four times the price of calcium carbonates (natural ground calcium carbonates or PCC), it is evident that the fill ratio is of paramount significance to the total cost of the paper. Every increase in the quantity of filler in the paper, no matter how small, signifies enormous savings in paper manufacture.

It is, therefore, extremely interesting to have access to a filler which combines the advantages of high level of brightness, a high level of opacity, and a high fill ratio.

However, on the other hand, it is necessary to take into consideration that the desirable properties for a paper filler, such as a high dispersion coefficient (opacity), are disadvantageous if such a filler is used as a coating pigment.

Paper coating requires pigments with optical and rheological properties which lie within very precisely defined limits. Wet-manufactured china clay and wet-ground natural calcium carbonates are the most commonly used pigments due to their suitable properties for this purpose, their relatively low price and their availability in large quantities.

Other pigments can be used to coat paper to achieve specific characteristics, but are used in small quantities, particularly due to their high cost and/or their limited technical properties. Pigments of this kind, such as titanium dioxide, calcined clay, plastic globules etc. are used because of their degree of brightness and their opacity, but are very expensive.

The essential basic characteristics required from a paper coating pigment are as follows:

a high level of brightness, preferably above 90 TAPPI fine particle distribution, with an average particle of between 0.5 and 2 microns the absence of coarse particles of more than 7 or 8 microns or less low medium requirement=low binder demand the opportunity of manufacturing coating masses with a high solid content and a low level of viscosity relatively inexpensive Wet-ground natural calcium carbonates are widely used and are generally preferred to kaolin because they have a better level of brightness (93–95) in comparison with kaolin (85–90).

The paper expert will select a pigment which produces a coating with the following properties at a given price:

optimum level of brightness optimum gloss optimum opacity excellent functioning and high speeds in the paper machine Precipitated calcium carbonates demonstrate many properties which make them suitable for use as coating pigments. They have a high level of brightness, can be manufactured in a wide range of particle sizes, and are available in large quantities at favourable prices.

Admittedly, precipitated calcium carbonates also have serious disadvantages which limit their application in paper coating. The main disadvantages are:

poor rheology of the coating colors, which leads to poor functioning of the coating plant a high medium requirement, which has a negative influence on the optical characteristics of the coated paper.

The most important factor is the manufacture of coating colors with a high solids content and relatively low viscosity, specifically without dilatancy or excessive thixotropy.

The smoothness, gloss and printing properties of the coated paper are all influenced by the ability to coat the paper with high solid contents, preferably in excess of 70%. This can only be achieved with coating pigments which have exceptional rheological properties and which are as Newtonian as possible.

Coating pigment slurries are generally produced with a solids content of 72, or preferably, 76%. By adding starch and latex, it is possible to add addtional water to the final coating color.

High solids concentrations of this kind are impossible to achieve with conventional precipitated calcium carbonates (PCC). The solids concentration of PCC slurries is genrally between 50 and 60%, which excludes their application in high solids coating processes.

Due to their other advantages, such as a high level of brightness (95%+) and high opacity-producing properties, PCC slurries are occasionally used in coating compositions and are added as dry pigments instead of slurries.

However, in this manner, their application is very restricted. The main problems occurring are:

dilatancy of the coating color, which necessitates a reduction in the speed of the coating plant high medium requirement (starch, latexes), which increases costs and has a negative influence on the gloss and printing properties of the coated paper.

For this reason, the quantity of PCC used in coating compositions rarely exceeds 50% in mass of the coating pigment.

The use of clacium carbonates, specifically natural or precipitated calcium carbonates, as paper fillers and as coating pigments is already familiar from the following documents:

| |
|---|
| U.S. Pat. No. 3,940,550 |
| U.S. Pat. No. 4,279,661 |
| U.S. Pat. No. 4,284,546 |
| U.S. Pat. No. 4,767,464 |

The products described in these patents have features which are either suitable for paper fillers on the one hand, or for paper coatings on the other, but do not have features which are suitable for both types of application.

In "The Advantages of Blending Ultrafine Ground Limestone and Scalenohedral Precipitated Calcium Carbonate as Filler for Alkaline Papers" (Papermakers Conference-Atlanta, August, 1988), M. D. Strutz, P. A. Duncan and J. C. Pflieger described an experiment to combine the advantages of both products.

In Nordic Pulp and Paper Research Journal No. 2, 1989, Robert A. Gill describes "the bahavior of on-site synthesized precipitated calcium carbonates and other calcium carbonate fillers on paper properties".

Recently, Joseph Ishley and Edward J. Osterhuber described a new precipitated calcium carbonate pigment for coated high-gloss papers (Coating Conference-Boston, May 1990).

"Papermakers Conference (1991)", pp. 293 to 298, describes precipitated calcium carbonates whose morphology is similar to that of titanium dioxide, in other words, they are not scalenohedral but rhombohedral.

All these patents and publications describe either paper fillers or coating pigments which can each be used for one part of the paper industry. As yet, there is no calcium carbonate (either natural or precipitated) with universal applications which fulfils the requirements for both uncoated and coated papers and which could be used in the modern paper industry, i.e. for paper machines and paper coating machines at high speeds.

One object of the present invention is, therefore, to prepare mineral fillers, pigments or similar materials containing carbonate which can be advantageously used both as a paper filler, particularly filler for paper pulp, and as a coating pigment.

This object was inventively solved by developing carbonate containing mineral fillers, pigments or similar materials containing carbonate with the following properties:

a) a rhombohedral or primarily round particle form b) a steepness factor (slope) of 1.1 to 1.4 c)

$$\text{a ratio } R = \frac{\%\text{ of particles} < 1\ \mu m}{\%\text{ of particles} < 0.2\ \mu m} \text{ from 8–19}$$

and d) an average statistical particle diameter of between 0.4 and 1.5 μm.

Ideally, the steepness factor has a value of between 1.2 and 1.4.

Ideally, the R value is 13.

Ideally, 80% of the particles have a length/width ratio of less than 4.

Ideally, the specific surface in accordance with BET has a value of between 6 $m^2/g$ and 13 $m^2/g$, preferably 12 $m^2/g$.

Ideally, the top cut has a value of between 4 and 7 μm, particularly 4 μm.

Ideally, the average statistical particle diameter is 0.5 to 0.9 μm, or better still 0.6 to 0.8 μm; the optimum diameter is 0.7 μm.

Ideally, the level of brightness according to TAPPI is >95.

Ideally, the top cut is between 4 and 7 μm, preferably 4 μm.

Ideally, 70 or 95% of the particles are less than 1 μm.

Ideally, 1 to 7% of the particles are less than 0.2 μm.

A combination of the following properties has been found to be particularly favourable:

a) a rhombohedral or primarily round particle form b) a steepness factor of between 1.1 and 1.4 c) a ratio R=8 to 19 d) 80% in mass of the particles has a length/width ratio of less than 4 e) a brightness level of at least 95 Tappi f) a specific surface of 6 to 15 $m^2/g$ g) an top cut of less than 7 μm and h) an average statistical particle diameter of between 0.4 and 1.5 μm.

Other preferred embodiments of the invention can be found in the description, the examples and the claims. The specialist terminology contained in the above explanation is defined as follows using terms with which experts are familiar and citing literature which is widely accessible to experts.

All fineness features for the products produced according to the invention were determined by means of sedimentation analysis under gravity using the SEDIGRAPH 5000 from the Micromeritics U.S.A. company. The average expert is familiar with this device, and it is used throughout the world to determine the quality of fillers and pigments. Measurement was conducted in a 0.1% mass aqueous $Na_4P_2O_7$ solution. Dispersion of the samples was conducted using fast agitators and ultrasound.

The particle distribution measured was portrayed on an X-Y plotter in the form of a continuous cumulative curve (c.f. for example Belger, P., Swiss Association of Paint and Ink Chemists, XVIIth FATIPEC Congress, Lugano 23 to 28 September 1984), whereby the particle diameter of a corresponding spherical diameter is entered on the X-axis and the proportion of particles as a mass percentage is entered on the Y-axis.

The fineness features defined below were derived or calculated form the curves obtained using the methods described above.

1. The top cut is the diameter of the coarsest particles in μm of the invented products or comparative products, in each case derived from the particle distribution curve obtained as described above.

2. The average particle diameter of the invented products or comparative products is the particle diameter in μm, derived from the X-axis at a value on the Y-axis of 50% mass of the particles.

For further information on these two definitions, please consult Belger, P., Swiss Association of Paint and Pigment Chemists, XVIIth FATIPEC Congress, Lugano, 23 to 28 September 1984).

3. The steepness factor is calculated according to the formula $$\frac{\text{Particle diameter in } \mu m \text{ at 50\% of mass}}{\text{Particle diameter in } \mu m \text{ at 20\% of mass}}$$

whereby in each case, the particle diameter is derived using the method described above.

4. Measurement of brightness (ISO brightness R 457) is conducted using light type D 65/10° by means of a double beam spectral photometer with diffuse illumination.

5. Measurement of the specific surface was conducted using the BET method in accordance with DIN 66132. The sample, which has been pre-dried to mass constancy at 105° C., was baked in a thermostat for 1 hour at 250° C. with nitrogen flushing Measurement was conducted using nitrogen ($N_2$) as a measuring gas whilst cooling with liquid nitrogen.

The invented product was not only designed in order to improve the chemical and physical properties of paper fillers and coating pigments, but also in order to do justice to the modern paper machines which run at very high speeds.

The invented products can be processed in a familiar manner in such a way that the parameters required according to the invention are achieved. This can be conducted, for example, by means of dry grinding followed by grading according to particle size using air separation. However, within the context of the invention, it is also possible to manufacture wet-ground or precipitated mineral fillers, pigments or similar materials containing carbonate with the properties according to the invention. The calcium carbonate in accordance with the invention may either be natural ground calcium carbonate or precipitated calcium carbonate, whereby the inventive combination of chemical and physical properties must always be adhered to.

It is the actual combination of properties required which leads to the unexpectedly good features of the invented product. There follows a more detailed description of the individual properties:

1. Particle form: Although the scalenohedral rosette form of PCC is advantageous for increasing opacity, the inventors discovered that the opacity of paper can also be achieved by other measures apart from increasing the dispersion coefficient of the individual particles. It has been shown that rhombic or essentially round-shaped particles are favourable for a whole range of properties:

1) They permit the manufacture of aqueous slurries with a high solid concentration at low viscosity, e.g. 76% solids content at 150 cp Brookfield 100 rpm, using sodium polyacrylates as a dispersion aid.

2) They permit the manufacture of coating colors with a high pigment concentration (e.g. 70%) with excellent rheological properties (no dilatancy).

3) They have a favourable influence on the gloss of the coated paper.

4) They permit high fill ratios (for uncoated papers).

For the above reasons, the rhombohedral solid particle form with the lowest possible length/width ratio is preferred. The inventors discovered that ideally, 80% mass proportion of particles must have a length/width ratio of less than 4.

This can be achieved using natural ground calcium carbonates without further processing. If precipitated calcium carbonates are to be used, the conditions of precipitation should be selected in such a way that scalenohedrons are avoided and calcitic rhombic crystals are encouraged.

Another opportunity for manufacturing PCC which is devoid of crystal clusters is to subject the PCC slurry to high shear forces in order to reduce the crystal conglomerates. For this purpose, the devices used for the delamination of china clay are suitable. With particle forms of this kind, paper can be filled up to fill ratios of between 25 and 35%.

2. Brightness: In the paper industry, fillers and pigments each with a high level of brightness are preferred. Calcium carbonates fulfil this condition. The level of brightness should be at least 95 (Tappi filter). This is relatively straightforward to achieve with PCC. Naturally ground carbonates, on the other hand, generally require treatment by means of chemical flotation in order to improve the brightness to this level. Flotation also has the advantage of eliminating impurities such as quartz, pyrite, chlorite etc. which generally accompany the limestone or marble and have a negative effect on the abrasion of the paper machines.

3. Average statistical particle diameter: It has been found that the average statistical particle diameter and the particle distribution are particularly important for the properties of paper fillers and coating pigments. If the average statistical particle diameter is too large, for example, as described in some of the patents mentioned above, this will lead to poor opaity. On the other hand, if the particle size is too fine, the connections between the fibres are loosened, and accordingly, the mechanical properties are detrimentally affected.

The invention found that the ideal particle size for calcium carbonates used as coating pigments is the range 0.4 to 1.5 μm (average statistical particle diameter). With particle sizes of this kind, it is possible to produce coated high-gloss papers.

4. Top cut "Top cut" refers to the size (in microns) of the coarsest particles of the product. For example, a top cut of 10 μm means that 100% of the particles are smaller than 10 microns. The top cut is particularly important for abrasion of the filler. The problem of abrasion of the sieves in the paper machinery becomes particularly critical if the fill ratio of the paper and the speed of the paper machine are increased.

It was found that by lowering the top cut, it is possible to significantly reduce the abrasion of the filler. Unexpectedly, it was found that in order to achieve fill ratios of between 25 and 30%, the product must have an Einlehner abrasion value of less than 3. This value indicates the weight loss of the sieve under the influence of an Einlehner grinding wheel at 174,000 revolutions.

Table 1 shows the abrasion value of various calcium carbonate fillers in relation to the top cut.

TABLE I

| | top cut in μm | Einlehner value | Maximum fill ratio |
|---|---|---|---|
| $CaCO_3$ no. 1 | 15 μm | 10 | 12% |
| $CaCO_3$ no. 2 | 10 μm | 7 | 15% |
| $CaCO_3$ no. 3 | 8 μm | 5 | 20% |
| $CaCO_3$ in accordance with the invention | 4 μm | 2.5 | <30% |

The maximum fill ration in table I is the level above which sieve abrasion is no longer acceptable.

The invention found that the top cut of the filler or pigment must be 7 microns or less.

Taking into account abrasion, the top cut is a more critical parameter than the average statistical particle diameter.

A top cut of 7 microns or less (ideally 5 microns) gives a negligible abrasion of the machine sieve at very high fill levels in the range of 25–30% or more, provided there is suitable drainage.

A lower top cut (less than 5 microns) is, therefore, particularly economical.

Furthermore, a top cut of 7 μm or less is necessary in order to achieve perfect smoothness and good gloss on the coated paper.

Technically, the required top cut is adjusted by subjecting the filler or pigment slurries to appropriate or centrifugation.

5. Specific surface: The specific surface according to BET in $m^2/g$ is a measurement of the porosity of the product. This characteristic is unexpectedly important for achieving maximum fill ratios and optimum rheological properties. It was found that a specific surface in excess of 19 $m^2/g$ reduces the possibility of increasing the fill ratio. In addition this also reduces the gloss of the coated paper. This is explained by the fact that the higher the specific surface, the more medium is required. On the other hand, however, a specific surface of less than 8 $m^2/g$ has unexpected disadvantages, for various reasons. When used as a filler, the mechanical properties were detrimentally affected and when used as a coating pigment, a lower specific surface of less than 6 $m^2/g$ would correspond to an average statistical particle diameter which is too coarse.

6. Particle distribution and the R ratio: Particle distribution in the invented products is determined using the "Sedigraph 5000" method described above. Average specialists throughout the world are familiar with the application of this device for this purpose.

FIG. 1 shows a typical particle distribution curve.

As described above, the particle form in the invented products is rhombic or essentially round. This particle form is advantageous with respect to good drainage on the paper machine, but is not suitable for a high dispersion coefficient and good opacity.

For this reason, other important features of the invention must be adhered to in order to achieve good opacity. Unexpectedly, it was found that the opacity of a paper at a given fill ratio can be increased by reducing the average statistical particle diameter to less than 1.5 microns but without increasing the particle content to less than 0.2 microns.

One would have expected that by reducing the particle size (or the average statistical particle diameter), the specific surface of the filler would be increased, and that this would theoretically increase the dispersion effect, and in turn, the opacity. However, experiments produced a disappointing result. A very large reduction in the average statistical particle diameter only produces a very slight increase in the opacity characteristics.

This phenomenon can be explained by the fact that by reducing the average statistical particle diameter to below 1.5 microns, at the same time, a relatively large proportion of ultra-fine particles of less than 0.25 microns are produced. These ultra-fine particles are smaller than the wavelength of light and, therefore, do not contribute to opacity. Depending on the grinding and precipitation conditions, the proportion of "unusable" particles of less than 0.25 microns may be 28% of mass with an average statistical diameter of 0.7 microns.

Therefore, the invention found that a filler or pigment, particularly calcium carbonate, should be used whose particle distribution is as narrow as possible, with an average statistical particle diameter of less than 1.5 microns.

At the same time, it was found that an excess of particles of less than 0.2 microns is also unfavourable for the gloss of the coated paper, which may be connected with the higher specific surface and accordingly, the higher medium requirement.

One method of calculating the number of particles less than 0.2 microns which are permissible within the context of the invention is to use the R ratio.

$$R = \frac{\text{\% of particles less than 1 micron}}{\text{\% of particles less than 0.2 microns}}$$

Under uncontrolled grinding or precipitation conditions, this proportion may even have a value as low as 2.6, for example.

$$\text{eg. } R = \frac{73\% < 1\ \mu m}{28\% < 0.2\ \mu m} = 2.6$$

According to the invention the value R must be equal to or greater than 8.

Table II illustrates comparative examples with respect to opacity (dispersion coefficient) of calcium carbonates according to the state of the art in comparison with the invented product.

TABLE II

| Filler type | Top cut in μm | Average particle diameter in μm | % of particles less than 1 μm | % of particles less than 0.2 μm | R | Dispersion coefficient | Steppness factor |
|---|---|---|---|---|---|---|---|
| #1 | 15 | 4 | 25 | 10 | 2.5 | <1000 | |
| #2 | 10 | 2.5 | 30 | 12 | 2.5 | <1000 | |
| #3 | 8 | 2.0 | 30 | 10 | 3.0 | 1200 | |
| #4 | 4 | 0.7 | 73 | 28 | 2.6 | 1400 | |
| invention #5 | 4.6 | 0.7 | 95 | 7 | 12.9 | 2500 | 1,21 |

7. Particle distribution and steepness factor:

Another essential feature of the present invention is the steepness factor (cf. FIG. 1). For a given average diameter (microns at 50%), particle distribution may be wide or narrow. With a wide particle distribution or a low steepness factor, the product will contain the full range of particle sizes, from very coarse particles to very fine particles. With a narrow particle distribution and a high steepness factor, the particle size range will be correspondingly small. At the limit, all particles will have the average diameter.

The steepness factor is expressed by the ratio $$\frac{\text{particle diameter in } \mu m \text{ at 50\% of mass}}{\text{particle diameter in } \mu m \text{ at 20\% of mass}}$$

This steepness factor is already known from the U.S. Pat. No. 4,767,464. This patent describes a calcium carbonate with a steepness factor of between 1.2 and 2.1 and a fraction of between 30 and 98 mass percentage of particles in the particle diameter range 0.5 to 1.8 μm. This patent does not describe the specific surface, the R ratio (see above) and the particle form, or the length/-width ratio of the particles, which play an essential part in the present invention.

The invention found that the best results with respect to opacity in the paper filler and gloss in the coating pigment were achieved with a steepness factor of less than 1.4.

A typical invented product has 50% of particles less than 0.7 μm and 20% of particles less than 0.5 μm.

Another typical invented product has 50% of particles less than 0.5 μm and 20% of particles less than 0.4 μm.

The combination of the above features in accordance with claim 1 and ideally, in accordance with the subclaims, leads to unexpectedly favourable properties of products containing carbonate, particularly calcium carbonate (natural or precipitated calcium carbonate) when used either as paper filler or as coating pigment.

The following tables III and IIIa illustrate a product according to the invention compared with three products according to the state of the art with respect to maximum fill ratio and with respect to opacity, whereby other physical parameters such as tear strength etc. are not significantly influenced by the higher fill ratio.

For sheet forming experiments, the following conditions were selected:

Stock composition wood-free sulphate cellulose, 20% mass pine, 80% mass birch, degree of beating 23° SR.

Retention aid 0.06% mass on dry paper, cationic polyacrylamide.

Sheet former rapid Köthen method.

TABLE III

| $CaCO_3$ | Top cut in μm | Average particle diameter in μm | % of particles less than 0.2 μm | Maximum fill ratio | Opacity |
|---|---|---|---|---|---|
| $CaCO_3$ no. 1 | 13 μm | 4 | — | 12% | 84% |
| $CaCO_3$ no. 2 | 10 | 2.5 | — | 15% | 86% |
| $CaCO_3$ no. 3 | 8 | 2 | — | 20% | 88% |
| $CaCO_3$ acc. to invention FIG. 1 | 4 | 0.7 | 7% | 25% | 91% |
| $CaCO_3$ no.5 | 4 | 0.8 | 20% | 20% | 89% |

TABLE IIIa

| $CaCO_3$ | Paper gloss |
|---|---|
| $CaCO_3$ no. 1 | 25% |
| $CaCO_3$ no. 2 | 33% |
| $CaCO_3$ no. 3 | 36% |
| $CaCO_3$ acc. to invention (FIG. 1) | 55% |
| $CaCO_3$ no. 5 | 48% |

In Table IIIa, a base paper was used for the coating experiments with a composition of wood-free sulphate cellulose, 20% mass pine, 80% mass birch, degree of beating 23° SR and 20% $CaCO_3$, no. 3.

The coating color composition used was as follows:

100 parts calcium carbonate 10.5 parts styrolacrylate latex 0.5 parts carboxymethyl cellulose Solids content 67% (adjusted with water)

pH 9 (adjusted with 5% soda lye)

and the coating conditions:

Laboratory coating machine (Bladecoater)

Quantity applied 12 g per $m^2$

Side coated : sieve upper side

Paper humidity after coating : 5.5% with the following glazing conditions:

Small Wefers-2 laboratory roller calender 4 passes, at 70 decanewtons per cm, roller temperature 80° C.

Gloss measurement was conducted in accordance with the Tappi standard T 480 OM-90, angle 75°.

The calcium carbonate measured was natural ground calcium carbonate in each case.

The inventive possibility of increasing the fill ratio to above 25% is the result of combining the features according to the patent claims.

Calcium carbonate according to the invention demonstrated unexpectedly good properties as a coating pigment with respect to rheology with a high solids content and with respect to gloss in coated paper.

Such good rheology might have been expected from rhombic particles, but not from the inventive control of particle distribution via the R ratio and the steepness factor. The improvement in the gloss of the coated paper seemed even less likely. The following table IV shows some comparative values.

TABLE IV

| | |
|---|---|
| Top cut | between 4 and 7 μm |
| % below 1 μm | between 70% and 95% |
| % below 0.7 μm | between 50% and 80% |
| % below 0.5 μm | between 20% and 60% |
| % below 0.2 μm | between 1% and 7% |

whereby preferably $R \geqq 8$

Steepness $\leqq 1.4$ and average particle diameter : 0.4–1.5 μm

Here too, the good properties are the result of a combination of the features according to the invention. Table IV contains typical calcium carbonates according to the invention.

According to the current state of the art in the paper industry, precipitated calcium carbonates (in the form of an aqueous slurry) are used as paper fillers, particularly to improve the opacity, and on the other hand, natural ground calcium carbonates are used as coating pigments in order to utilize their excellent rheology.

The present invention has for the first time made it possible to use a single product which can be used equally as paper filler and as a coating pigment An additional advantage is the consequent simplification of handling, the supply tanks for the slurries, and equipment.

I claim:

1. Mineral fillers or pigments containing calcium carbonate having a) a rhombohedral or round particle shape b) a steepness factor (slope) of between 1.1 and 1.4 c)

$$\text{a ratio } R = \frac{\%\text{ of particles} < 1\ \mu m}{\%\text{ of particles} < 0.2\ \mu m} = 8\text{–}19$$

and d) an average statistical particle diameter of between 0.4 and 1.5 μm.

2. Mineral fillers or pigments containing calcium carbonate in accordance with claim 1, having a steepness factor between 1.2 and 1.4.

3. Mineral fillers or pigments containing calcium carbonate in accordance with claim 1, having a ratio R between 8 and 14.

4. Mineral fillers or pigments containing calcium carbonate in accordance with claim 1, having 80% mass of the particles with a length/width ratio of less than 4.

5. Mineral fillers or pigments containing calcium carbonate in accordance with claim 1, having a specific surface of between 6 and 19 $m^2/g$.

6. Mineral fillers or pigments containing calcium carbonate in accordance with claim 1, having a specific surface of between 6 and 15 $m^2/g$ and a top cut of less than 7 μm.

7. Mineral fillers or pigments containing calcium carbonate in accordance with claim 1, having a specific surface in accordance with BET between 6 and 13 $m^2/g$.

8. Mineral fillers or pigments containing calcium carbonate in accordance with claim 1, having a top cut between 4 and 7 μm.

9. Mineral fillers or pigments containing calcium carbonate in accordance with claim 1, having an average statistical particle diameter between 0.5 and 0.9 μm.

10. Mineral fillers or pigments containing calcium carbonate in accordance with claim 1, having a brightness level of >95 Tappi.

11. Mineral fillers or pigments containing calcium carbonate in accordance with claim 1, having a top cut of 6 μm.

12. Mineral fillers or pigments containing calcium carbonate in accordance with claim 1, having 70% of the particles <1 μm.

13. Mineral fillers or pigments containing calcium carbonate in accordance with claim 1, having 95% of the particles <1 μm.

14. Mineral fillers or pigments containing calcium carbonate in accordance with claim 1, having <5% of the particles <0.2 μm.

15. Mineral fillers or pigments containing calcium carbonate in accordance with claim 1, having <7% of the particles <0.2 μm.

16. Mineral fillers or pigments containing calcium carbonate in accordance with claim 1, having a) a rhombohedral or round particle shape b) a steepness factor of between 1.1 to 1.4 c)

$$\text{a ratio } R = \frac{\%\text{ of particles} < 1\ \mu m}{\%\text{ of particles} < 0.2\ \mu m} = 8\text{–}19$$

d) a specific surface of between 6 and 15 $m^2/g$ and e) a top cut of less than 7 μm f) an average statistical particle diameter of between 0.4 and 1.5 μm, g) 80% mass of the particles have a length/width ratio of less than 4 and h) a brightness level of at least 95 Tappi.

17. Mineral fillers or pigments containing calcium carbonate in accordance with claim 1, wherein said calcium carbonate is selected from the group of natural and precipitated calcium carbonate.

18. Mineral fillers or pigments containing calcium carbonate in accordance with claim 1, having 80% of the particles <1 μm.

19. A composition for use in the paper industry as a paper filler or a coating pigment comprising the filler or pigment of claim 1.

* * * * *

US005292365B1

REEXAMINATION CERTIFICATE (3015th)

United States Patent [19]

Delfosse

[11] B1 5,292,365

[45] Certificate Issued Oct. 1, 1996

[54] MINERAL FILLERS AND PIGMENT CONTAINING CARBONATE

[75] Inventor: Pierre Delfosse, Rutland, Vt.

[73] Assignee: Pluess-Staufer AG, Oftringen, Switzerland

Reexamination Request:
No. 90/003,675, Dec. 29, 1994

Reexamination Certificate for:

| | |
|---|---|
| Patent No.: | **5,292,365** |
| Issued: | **Mar. 8, 1994** |
| Appl. No.: | **936,269** |
| Filed: | **Aug. 27, 1992** |

[51] Int. Cl.[6] ..... C04B 14/28

[52] U.S. Cl. ..... 106/464; 106/400; 106/463; 423/430

[58] Field of Search ..... 106/400, 463, 106/464; 423/430

[56] References Cited

U.S. PATENT DOCUMENTS

| | | | |
|---|---|---|---|
| 4,714,603 | 12/1987 | Vanderheiden | 423/432 |
| 4,732,748 | 3/1988 | Stewart et al. | 423/430 |
| 5,269,818 | 2/1993 | Kunesh et al. | 423/432 |

FOREIGN PATENT DOCUMENTS

| | | |
|---|---|---|
| 55088 | 6/1982 | European Pat. Off. . |
| 853073252 | 4/1986 | European Pat. Off. . |
| 1592147 | 4/1980 | Germany . |
| 57-071494 | 5/1982 | Japan . |
| 62-087414 | 10/1985 | Japan . |
| 3-894 | 10/1991 | Japan . |
| 92-21613 | 12/1992 | WIPO . |
| 93-20010 | 10/1993 | WIPO . |

OTHER PUBLICATIONS

Robert Gill, et al., "The Relative Effects of Different Calcium Carbonate Filler Pigments on Optical Properties," Jan. 1987 TAPPI Journal.

R. A. Gill, "Satellite PCC–The Behavior of Various Carbonate Fillers and Blends on Paper Properties," 1988 Papermakers Conference (no month).

R. A. Gill, "The Behavior of On–Site Synthesized PCC's and Other Calcium Carbonate Fillers on Paper Properties," 1989–Nordic Pulp and Paper Research Journal (no month).

J. N. Ishley, et al., "A New Precipitated Calcium Carbonate Pigment for High Gloss Coated Papers," 1990 Coating Connference (no month).

J. D. Passaretti, et al, "High Opacity Fillers—A New PCC Morphology and Its Properties in Wood Free and Wood Containing Paper," 1991–Papermakers Conference (Apr. '91).

G. H. Fairchild,"PCC Approaches to Achieve Higher Filler Levels in Alkaline Papers," 1992–78th Annual Meeting (no month).

J. D. Passaretti, et al., "Application of High Opacity PCC", 1993 TAPPI Journal (no month).

A Sampling of Current Specialty Minerals PPC Products, Brochure: (no date).

Albacar Lo Slurry (no date).

Albacar Ho Slurry (no date).

(List continued on next page.)

*Primary Examiner*—Michael Marcheschi

[57] ABSTRACT

Mineral fillers, pigments and similar materials containing carbonate are described which are characterized in that they have a) a rhombohedral or primarily round particle form b) a steepness factor of between 1.1 and 1.4 c)

$$\text{a ratio } R = \frac{\%\text{ of particles} < 1\ \mu\text{m}}{\%\text{ of particles} < 0.2\ \mu\text{m}} = 8 \text{ to } 19$$

and d) an average statistical particle diameter of between 0.4 and 1.5 μm.

These materials may be used in the paper industry both as paper fillers and as coating pigments.

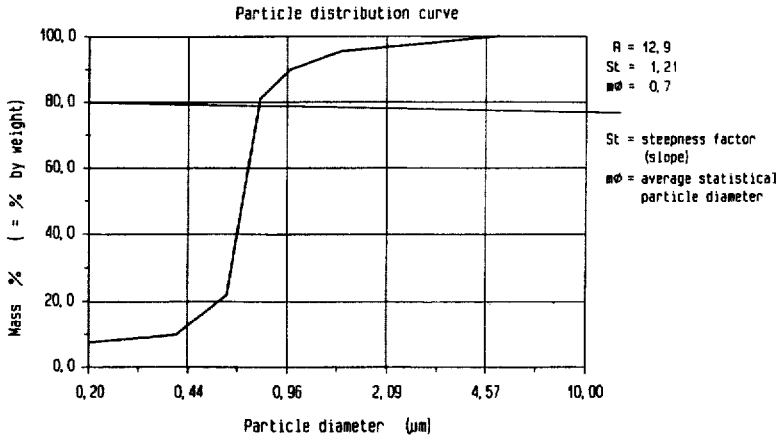

OTHER PUBLICATIONS

Albacar 5970 Dry (no date).
Albaglos Dry (no date).
Albaglos S (no date).
Albafil XL Slurry (no date).
Albaglos Slurry (no date).
S. Lowell, "Introduction To Powder Surface Area" (1979) Cover, Frontpage, pp. 3–5 (no month).

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 4, 10 and 19 are cancelled.

Claims 1–3, 5–9 and 11–18 are determined to be patentable as amended.

1. [Mineral fillers or pigments] *A calcium carbonate composition* containing calcium carbonate having a) a rhombohedral or round particle shape, b) a steepness factor (slope) of between 1.1 and 1.4, c)

$$\text{a ratio } R = \frac{\text{\% of particles} < 1\ \mu\text{m}}{\text{\% of particles} < 0.2\ \mu\text{m}} = 8\text{–}19,$$

[and]

d) an average statistical particle diameter of between 0.4 and 1.5 μm, *and*

*e) a brightness level of >95 Tappi.*

2. [Mineral fillers or pigments containing calcium carbonate] *The composition* in accordance with claim 1, [having] *wherein said calcium carbonate has* a steepness factor between 1.2 and 1.4.

3. [Mineral fillers or pigments containing calcium carbonate] *The composition* in accordance with claim 1, [having] *wherein said calcium carbonate has* a ratio R between 8 and 14.

5. [Mineral fillers or pigments containing calcium carbonate] *The composition* in accordance with claim 1, [having] *wherein said calcium carbonate has* a specific surface of between 6 and 19 $m^2/g$.

6. [Mineral fillers or pigments containing calcium carbonate] *The composition* in accordance with claim 1, [having] *wherein said calcium carbonate has* a specific surface of between 6 and 15 $m^2/g$ and a top cut of less than 7 μm.

7. [Mineral fillers or pigments containing calcium carbonate] *The composition* in accordance with claim 1, [having] *wherein said calcium carbonate has* a specific surface in accordance with BET between 6 and 13 $m^2/g$.

8. [Mineral fillers or pigments containing calcium carbonate] *The composition* in accordance with claim 1, [having] *wherein said calcium carbonate has* a top cut between 4 and 7 μm.

9. [Mineral fillers or pigments containing calcium carbonate] *The composition* in accordance with claim 1, [having] *wherein said calcium carbonate has* an average statistical particle diameter between 0.5 and 0.9 μm.

11. [Mineral fillers or pigments containing calcium carbonate] *The composition* in accordance with claim 1, [having] *wherein said calcium carbonate has* a top cut of 6 μm.

12. [Mineral fillers or pigments containing calcium carbonate] *The composition* in accordance with claim 1, [having] *wherein said calcium carbonate has* 70% of the particles <1 μm.

13. [Mineral fillers or pigments containing calcium carbonate] *The composition* in accordance with claim 1, [having] *wherein said calcium carbonate has* 95% of the particles <1 μm.

14. [Mineral fillers of pigments containing calcium carbonate] *The composition* in accordance with claim 1, [having] *wherein said calcium carbonate has* <5% of the particles <0.2 μm.

15. [Mineral fillers or pigments containing calcium carbonate] *The composition* in accordance with claim 1, [having] *wherein said calcium carbonate has* <7% of the particles <0.2 μm.

16. [Mineral fillers or pigments] containing calcium carbonate [in accordance with claim 1,] *A calcium carbonate composition* having a) a rhombohedral or round particle shape, b) a steepness factor (*slope*) of between 1.1 and 1.4, c)

$$\text{a ratio } R = \frac{\text{\% of particles} < 1\ \mu\text{m}}{\text{\% of particles} < 0.2\ \mu\text{m}} = 8\text{–}19,$$

d) a specific surface of between 6 and 15 $m^2/g$ [and], e) a top cut of less than 7 μm, f) an average statistical particle diameter of between 0.4 and 1.5 μm, *and* g) [80% mass of the particles have a length/width ratio of less than 4 and h)] a brightness level of at least 95 Tappi.

17. [Mineral fillers or pigments containing calcium carbonate] *The composition* in accordance with claim 1, wherein said calcium carbonate is selected from the group of natural and precipitated calcium carbonate.

18. [Mineral fillers or pigments containing calcium carbonate] *The composition* in accordance with claim 1, [having] *wherein said calcium carbonate has* 80% of the particles <1 μm.

* * * * *